US008898961B1

(12) United States Patent
Cline

(10) Patent No.: US 8,898,961 B1
(45) Date of Patent: Dec. 2, 2014

(54) METAL SEAM MOUNT

(71) Applicant: Roger M. Cline, Bluemont, VA (US)

(72) Inventor: Roger M. Cline, Bluemont, VA (US)

( * ) Notice: Subject to any disclaimer, the term of this patent is extended or adjusted under 35 U.S.C. 154(b) by 0 days.

(21) Appl. No.: 13/836,351

(22) Filed: Mar. 15, 2013

Related U.S. Application Data

(60) Provisional application No. 61/611,146, filed on Mar. 15, 2012.

(51) Int. Cl.
*E04D 13/00* (2006.01)
*F16M 13/02* (2006.01)
*E04D 13/10* (2006.01)

(52) U.S. Cl.
CPC ..... *E04D 13/10* (2013.01); *F16M 13/02* (2013.01)
USPC ..... 52/24; 52/26; 52/97; 52/25; 52/302.6

(58) Field of Classification Search
CPC . E04D 13/00; E04D 13/103; E04D 2003/285; E04D 3/06; E04D 3/366
USPC ..... 52/24, 26, 97, 302.6, 25
See application file for complete search history.

(56) References Cited

U.S. PATENT DOCUMENTS

| | | | | |
|---|---|---|---|---|
| 5,282,340 | A * | 2/1994 | Cline et al. | 52/24 |
| 6,164,033 | A * | 12/2000 | Haddock | 52/545 |
| 6,688,047 | B1 * | 2/2004 | McNichol | 52/25 |
| 7,127,852 | B1 * | 10/2006 | Dressler | 52/24 |
| 7,774,989 | B2 * | 8/2010 | Fisher | 52/26 |
| 8,528,888 | B2 * | 9/2013 | Header | 269/91 |
| 2005/0108952 | A1 * | 5/2005 | Trevorrow et al. | 52/25 |
| 2006/0156636 | A1 * | 7/2006 | Walker et al. | 52/11 |
| 2007/0051053 | A1 * | 3/2007 | Hockman | 52/25 |
| 2010/0000161 | A1 * | 1/2010 | Fisher | 52/26 |
| 2010/0171016 | A1 * | 7/2010 | Haddock | 248/237 |
| 2011/0247292 | A1 * | 10/2011 | Li | 52/698 |
| 2012/0151867 | A1 * | 6/2012 | Smith et al. | 52/588.1 |

* cited by examiner

*Primary Examiner* — Mark Wendell
(74) *Attorney, Agent, or Firm* — James Creighton Wray

(57) ABSTRACT

Snow guards and mounts for attaching to seams of metal roofs have tops, spaced sides and inward and downward extending holes for elliptical tipped set screws. Square recesses opposite inner extremities of the holes form square bends in the seams. One screw and recess deform two layers below a rolled seam. Another screw and recess deform five layers in the rolled seam. Bottom lobes near one support provide a lowered hole and a lowered opposite recess. Snow blades extend upward and outward from the top and sides and downward to near a level of the bottoms of the sides.

27 Claims, 19 Drawing Sheets

METAL SEAM MOUNT

This application claims the benefit of U.S. Provisional Application No. 61/611,146 filed Mar. 15, 2012, which is hereby incorporated by reference in its entirety as if fully set forth herein.

BACKGROUND OF THE INVENTION

Double lock standing seams or double standing seams in metal roofs are formed as rectangular reentrant bends in edges of overlapping metal sheets. The seams stand about one inch or more above the plane of the sheets, and the rectangular reentrant bends occupy about an upper one-half inch of the seams.

Connectors to connect objects, for example snow guards, to the roof have grooved bodies for spanning the seams. Threaded openings in one side of the groove receive screws. The opposite side has spheroid internal recesses for receiving and holding portions of the seams that are pushed into the recesses by the screws. The screws should be tightened sufficiently to distort and hold the seams using powered wrenches or hand operated wrenches. When torqued sufficiently for the screws to deform the metal of the seam into the spheroid recesses and thus prevent dislodgment of the snow guard from the seam, the screws acting through the seam and recesses may distort inferior bodies causing them to crack or split. When the screws are tightened insufficiently, the mounts may slide along or off the seams, causing possible damage to the roof or objects below.

Fasteners historically have been perpendicular to the seam and parallel with the plane of the roof surface or panel and have made for difficult installations due to their close proximity to the panel, leaving little room for either hand or electric impact tools. Additionally, the sight line of the installer is impeded by the close proximity to the roof panel surface. As such installer frustration and roof panel damage are common in the trade.

Needs exist for improved metal seam mounts.

SUMMARY OF THE INVENTION

The invention provides new shapes of the bodies, angular tapped holes, and angularly related planar-sided recesses that provide improved seam gripping.

The new bodies have first and second ends, tops extending between the ends and spaced apart and opposite first and second sides extending downward from the top. The spaces between the sides are at least wide enough to receive double standing seams of a metal roof. Downward extended lobes are provided on bottoms of the opposite sides nearer of the first ends of the bodies. The lobes allow varied location of the holes and recesses and lowering of the hole and recess by the lobes for gripping the parallel two layers of upward bent portions of the metal roof plates below the five-layer rolled seam between one screw and recess and gripping the five-layer rolled seam between another screw and recess. First and second tapped holes extend inward and downward through the first side. The first holes near the first ends of the bodies are aligned with the downward extended lobes. The lugs or lobes allow one of the elliptical-tipped set screws to push and deform a five-layer double seam upper part of the seam. The other set screw pushes and deforms the lower two-layer part of the seam and prevents the screw and body from being lifted from the seam. The inward and downward angles of the tapped through holes in the first sides of the bodies have several advantages. The inward and downward angles allow access and connection to the set screw or bolt heads with air or electric powered wrenches or hand operated wrenches without touching the roof and without interference of the wrenches from the flat metal roof plates. Upward angled holes in the grooved body allow a better visual sightline to the fastener and allow ample clearance between tools used to torque the fastener and the panel surface, thus helping prevent damage or marring to finish. The inward and downward extending holes allow the tips of the fasteners or set screws to contact lower areas of the roof seams. For example, at least one of the set screw elliptical tips contacts the seams in a two-layer area below the upper five-layer folded area.

The first and second sides respectively have first and second inner surfaces, and wherein the downward angle of the at least one fastener-receiving threaded hole is about 5° to 20° to a direction perpendicular to the first inner surface. The first and second sides respectively have first and second inner surfaces, and wherein the downward angle of the at least one fastener-receiving threaded hole is about 10° to a direction perpendicular to the first inner surface.

The new angle of the bolts or set screws produces additional new functions. The new angular force direction reduces normal force between the opposite sides of the mount when torqueing the bolts, reducing elongation, separation of the sides and fractures of the mounts.

The angular recesses, for example rectangular recesses, provide linear contact of the side, top and bottom edges of the recesses with the portions of the seams which are pushed into the recesses by the elliptical tips of the set screws as the screws are tightened by wrenches. The screw and recess-deformed areas of the seams form linear sides which engage the linear sides of the recesses, providing increased resistance to the body sliding along or moving on the seam in any direction.

The new angular direction helps to distort the metal sheets and seams into the opposite recesses and against the 90° side, lower and upper edges of the recess, locking the mount in place, both along the seam and perpendicular to the seam or vertically upwards from the roof panel.

The elliptical ends of the fasteners and set screws push and, in cooperation with the recesses, deform the seams without scoring or tearing the seams.

The snow blades are connected to the bodies and extend upward, outward and downward to positions aligned nearly opposite to the lower extensions of the sides to prevent or retard snow or ice slides below the blade levels.

These and further and other objects and features of the invention are apparent in the disclosure, which includes the above and ongoing written specification, with the claims and the drawings.

DETAILED DESCRIPTION

Figure 1:
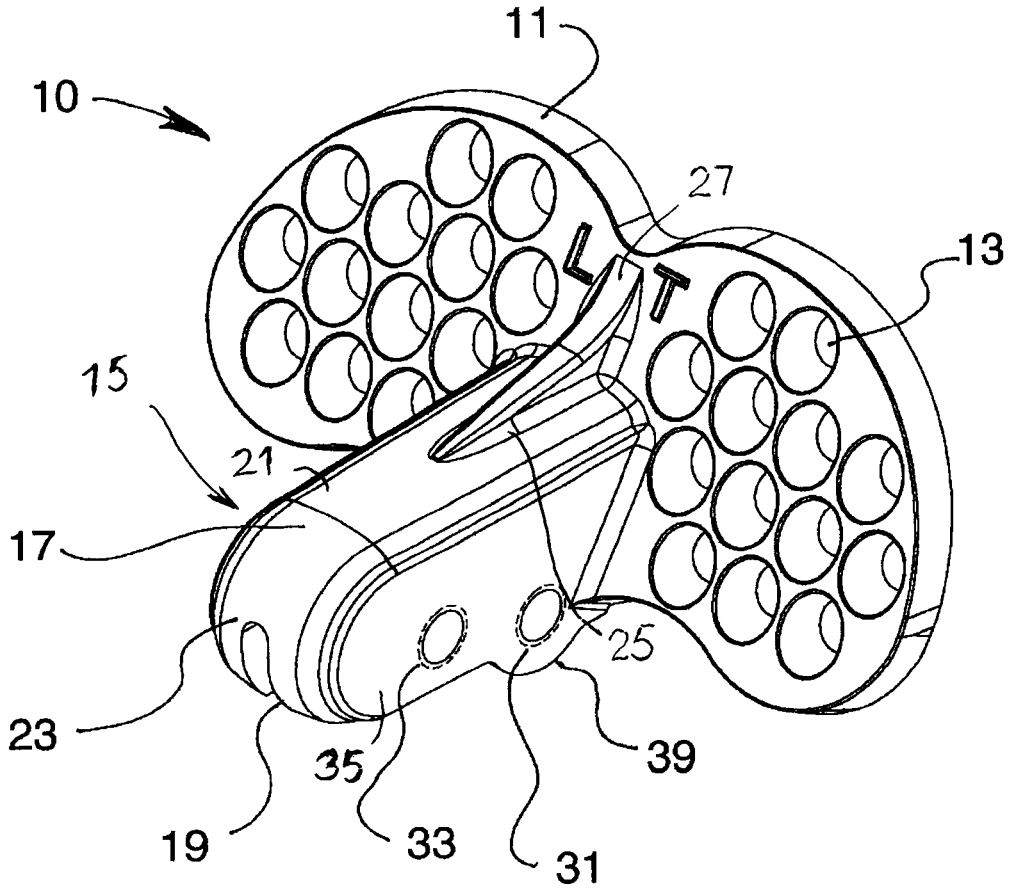
FIG. 1 is an isometric view of a snow brake shown without the fasteners.
Figure 2:
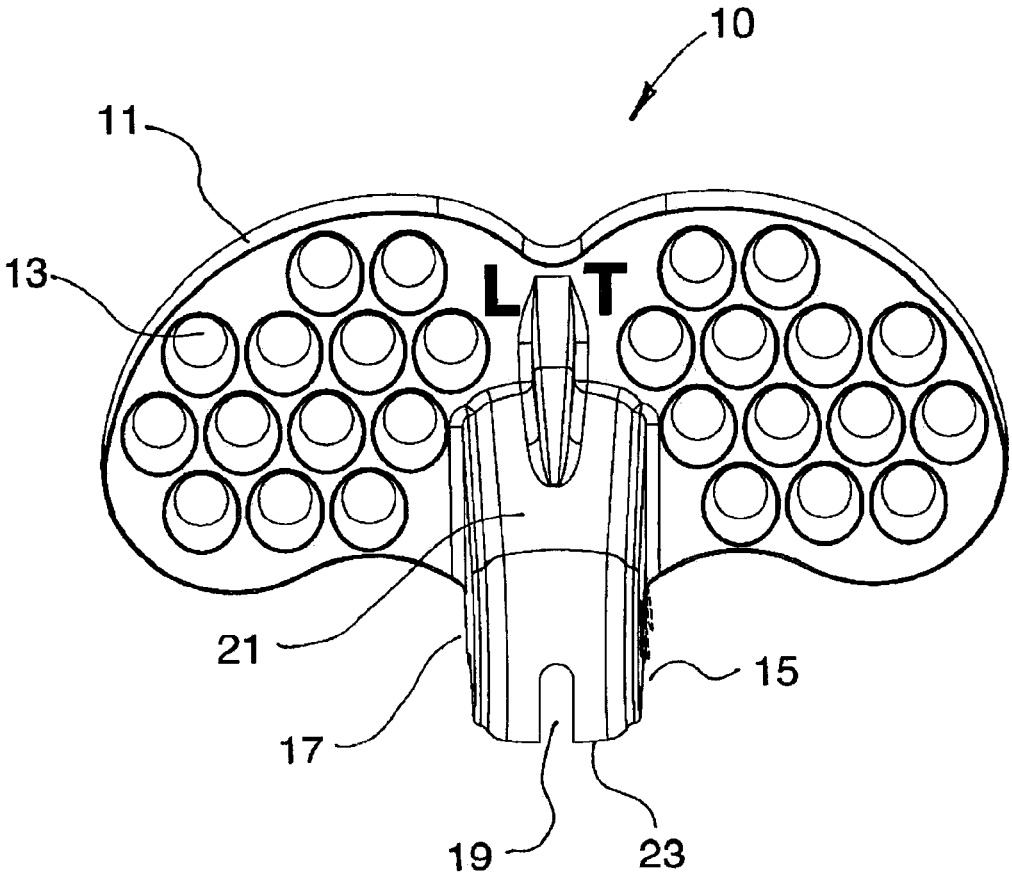
FIG. 2 is a front view of the snow brake shown in FIG. 1.
Figure 3:
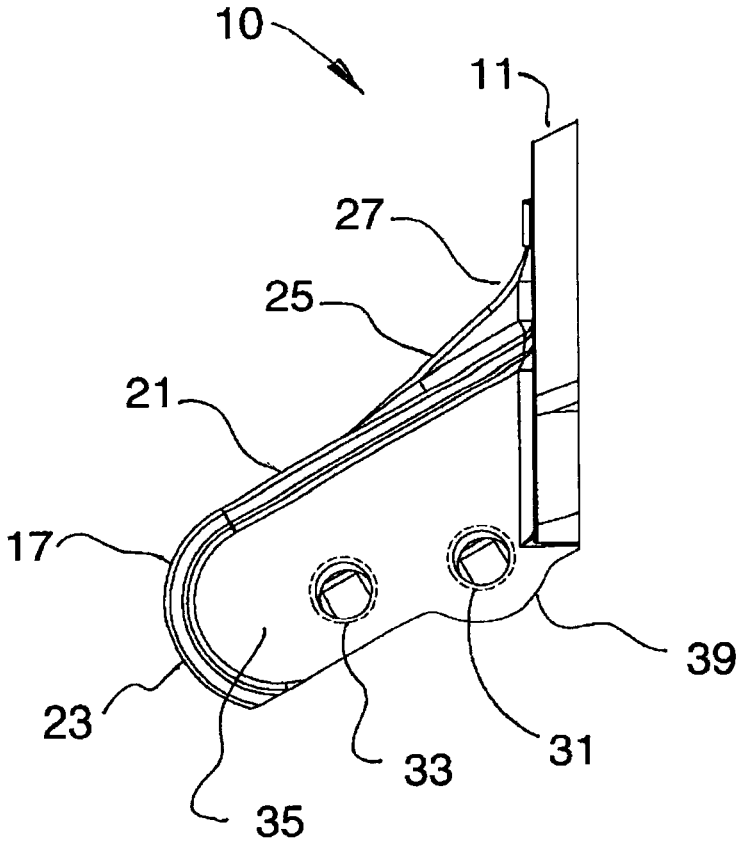
FIG. 3 is a right side view of the snow brake shown in FIG. 1.
Figure 4:
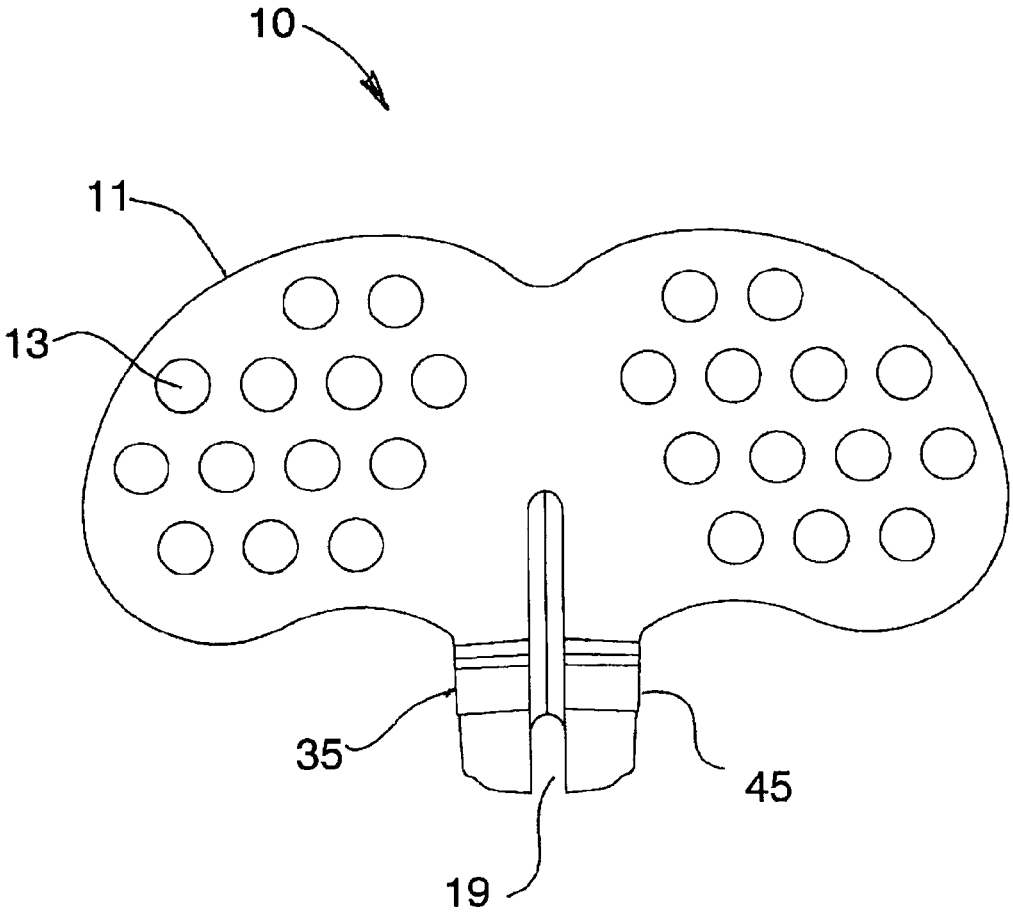
FIG. 4 is a back view of the snow brake shown in FIG. 1.
Figure 5:
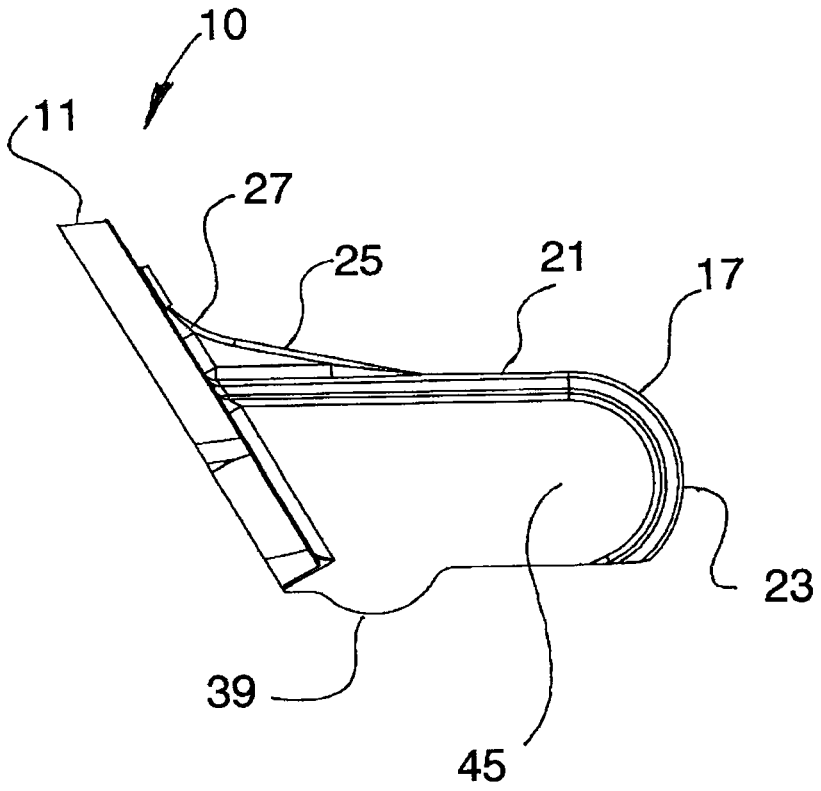
FIG. 5 is a left side view of the snow brake shown in FIG. 1.
Figure 6:
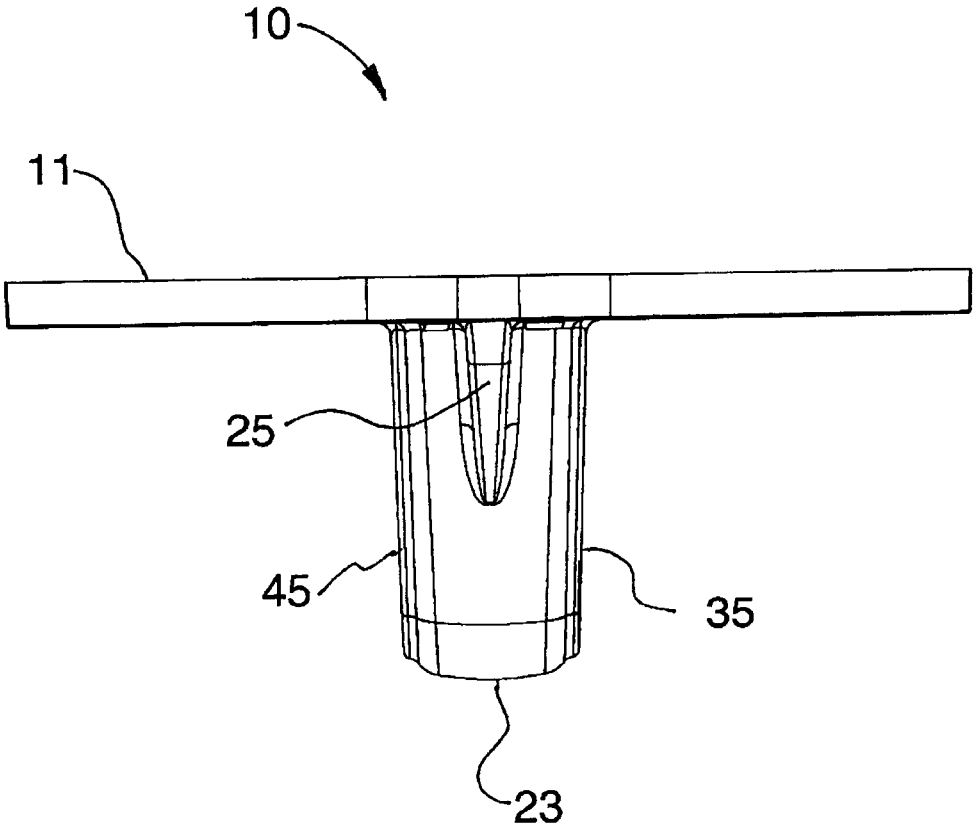
FIG. 6 is a top of the snow brake shown in FIG. 1.
Figure 7:
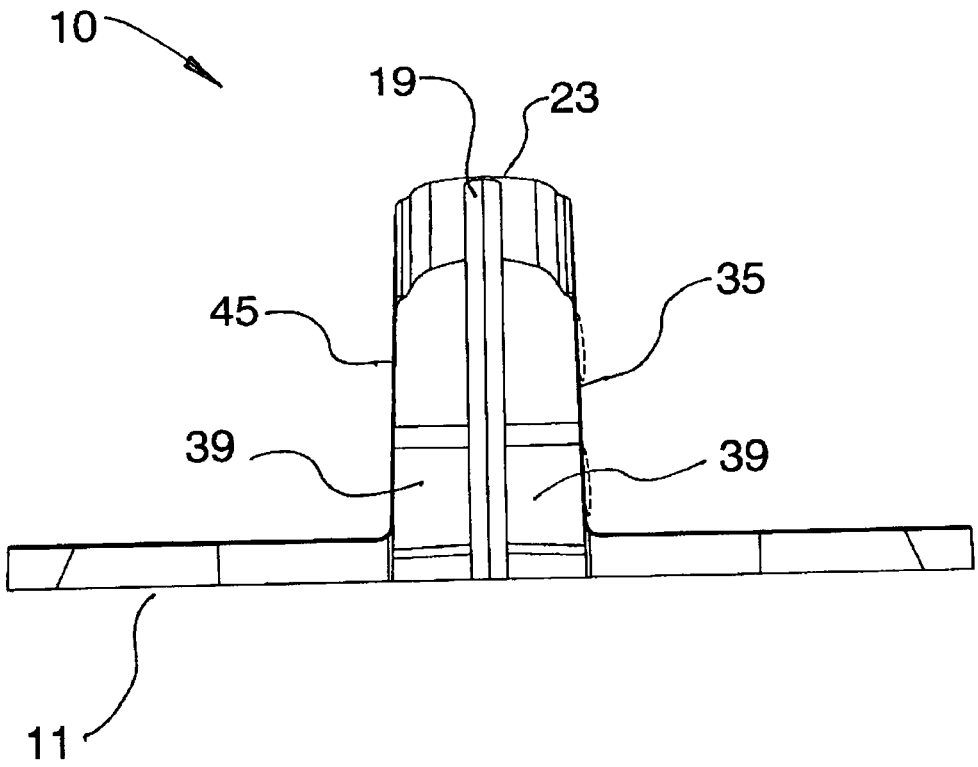
FIG. 7 is a bottom view of the snow brake shown in FIG. 1.
Figure 8:
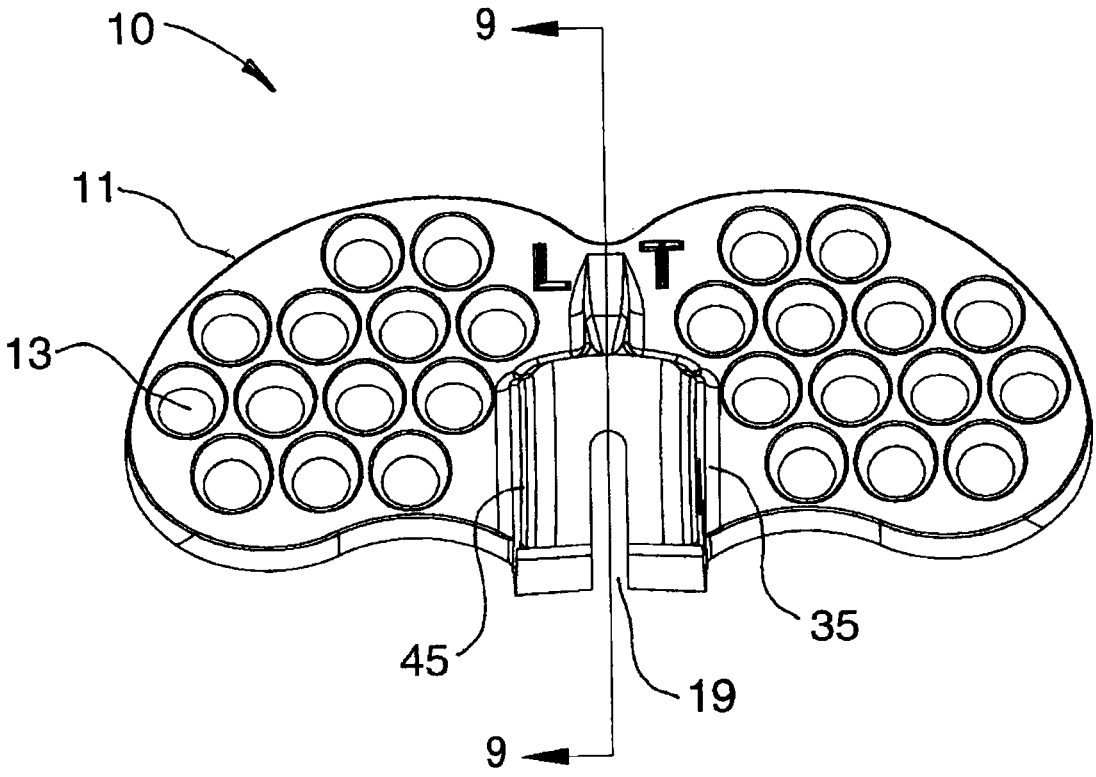
FIG. 8 is a front view of the snow brake looking along the seam line.
Figure 9:
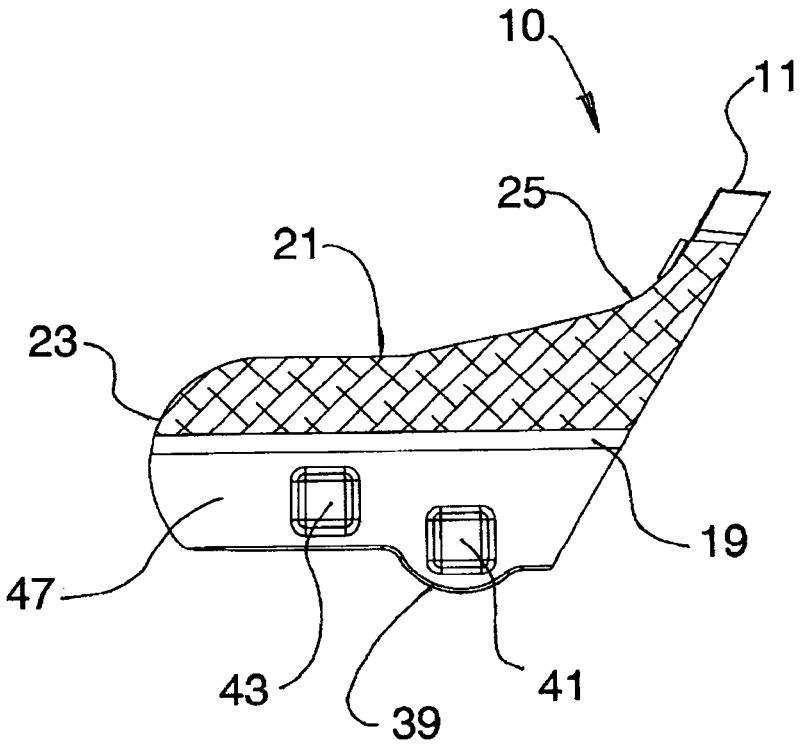
FIG. 9 is a section view taken along line 9-9 in FIG. 8.
Figure 10:
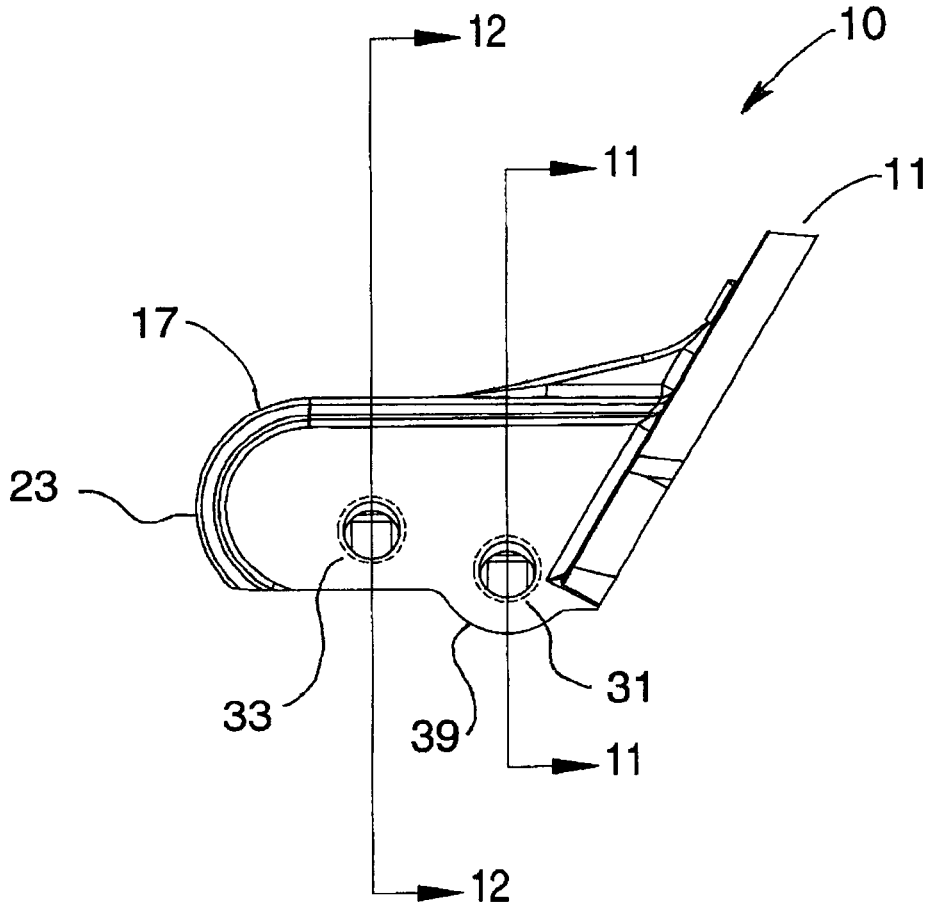
FIG. 10 is a right side view of the snow brake shown in FIG. 8.
Figure 11:
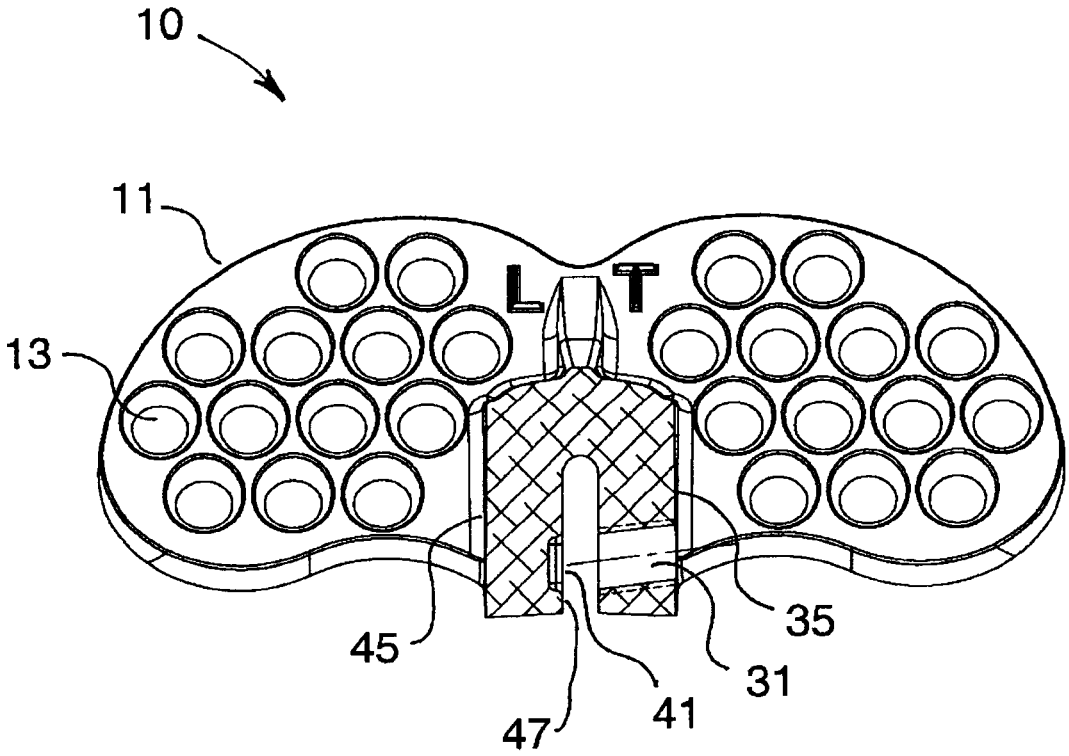
FIG. 11 is a section view taken along line 11-11 in FIG. 10.
Figure 12:
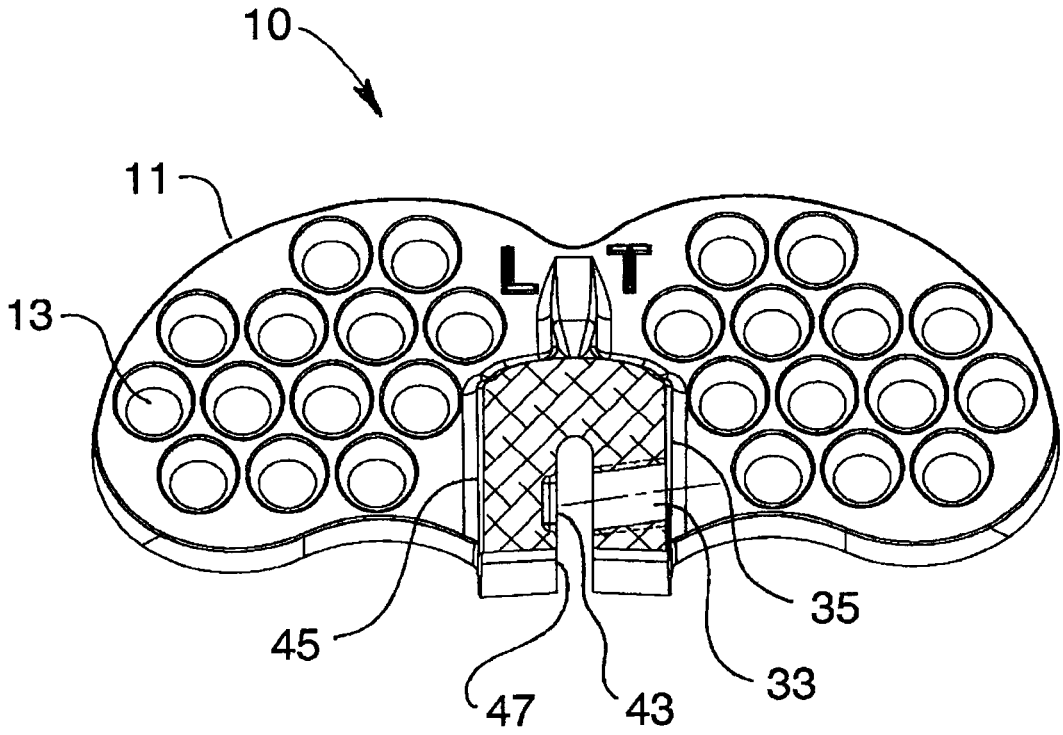
FIG. 12 is a section view taken along line 12-12 in FIG. 10.
Figure 13:
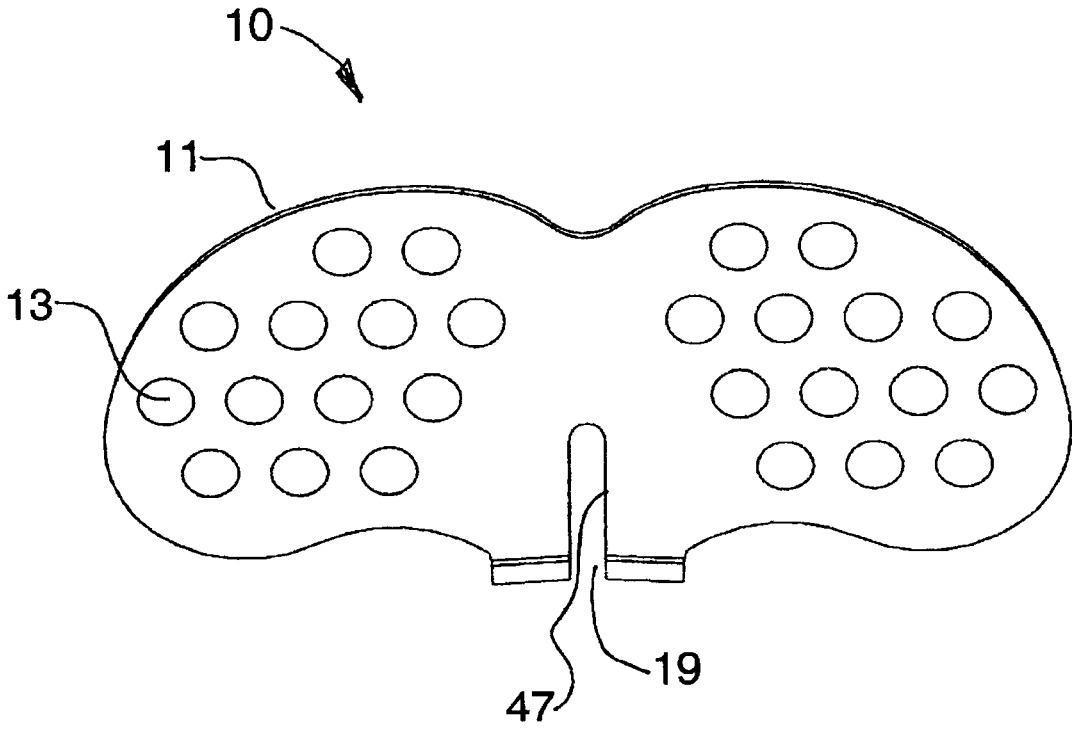
FIG. 13 is a back view of the snow brake shown in FIG. 8.

A snow brake 10 shown in FIGS. 1-13 is an example of a metal plate seam mount. Snow brake 10 has a flat snow blade 11 with holes 13. A seam mounting and clamping portion 15 has a body 17 with an upward groove 19 that extends through the mounting portion body 17 and the flat blade 11. A top 21 and front 23 of the body 17 has a rigidifying gusset 25 which curves 27 onto the front of the blade 11. The snow brake is cast as a single unit.

Threaded downward angled holes 31, 33 are formed through one side 35 of the body. Complementary rectangular or square recesses 41, 43 are formed in the opposite side's 45 inner face 47. The first and second sides respectively have first and second inner surfaces, and wherein the downward angle of the at least one fastener-receiving threaded hole is about 5° to 20° to a direction perpendicular to the first inner surface. The first and second sides respectively have first and second inner surfaces, and wherein the downward angle of the at least one fastener-receiving threaded hole is about 10° to a direction perpendicular to the first inner surface.

The hole 31 and recess 41 are centered in or above the downward extended lobes 39 on opposite sides 35 and 45 of the body 17.

The holes 31, 33 receive elliptical tipped set screw fasteners that are downward angled and that are tightened to engage and distort the seam and to press opposite sides of the seam into the linear and angular recesses 41, 43. The downward angled holes 31 and 33 and the complementary recesses 41 and 43 are at different levels to engage different parts of the seams. The hole 31 and complementary recess 41 are positioned below the hole 33 and recess 43. A set screw in hole 31 and the recess 41 engage with the upstanding two-layer parallel metal plate portions below the five-layer rolled seam to distort the parallel plate portions and to press them into the linearly edged receiver. A set screw turned in hole 33 and recess 43 cooperate with the five-layer rolled seam to distort the seam and press it partially into the linear edged recess 43.

The set screws in holes 31, 33 and recesses 41, 43 engage the two-layer part of the double-standing seam beneath the upper rolled five-layer part of the seam, anchoring the body 17 against lifting. The set screws in holes 31 and recesses 41 cooperate to press, bend, distort and hold an upper five-layer portion of the seam against the multiple linear edges of recess 41.

Figure 14:
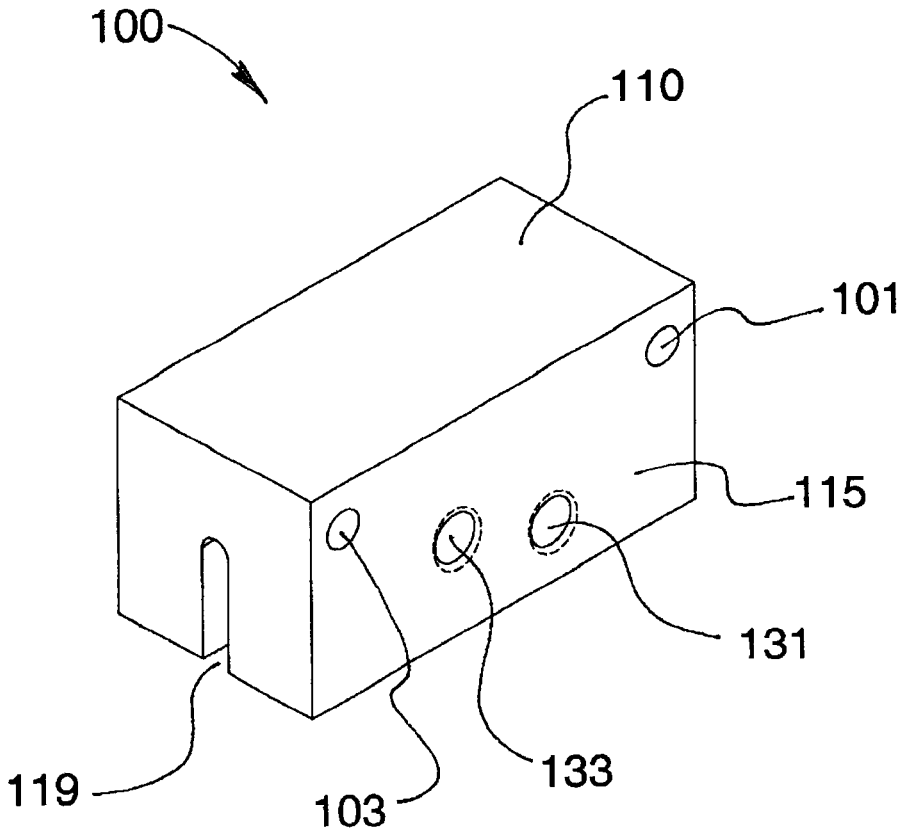
FIG. 14 is an isometric view of a mounting block shown without the fasteners.
Figure 15:
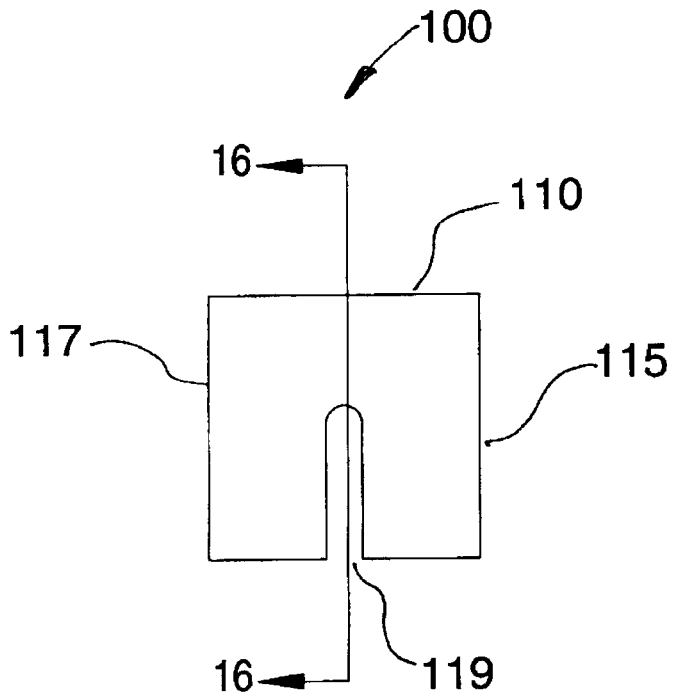
FIG. 15 is a front view of the mounting block shown in FIG. 14.
Figure 16:
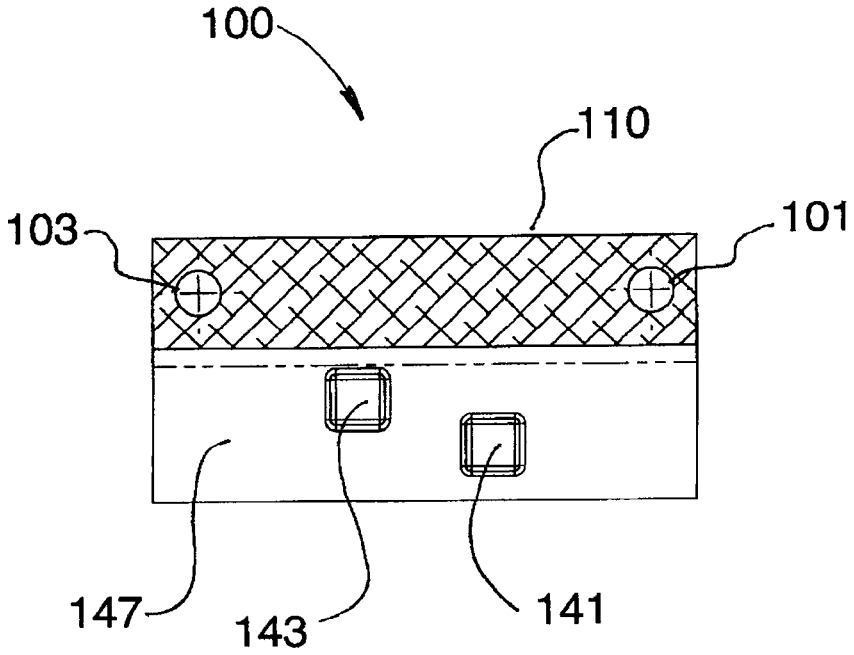
FIG. 16 is a section view taken along line 16-16 in FIG. 15.
Figure 17:
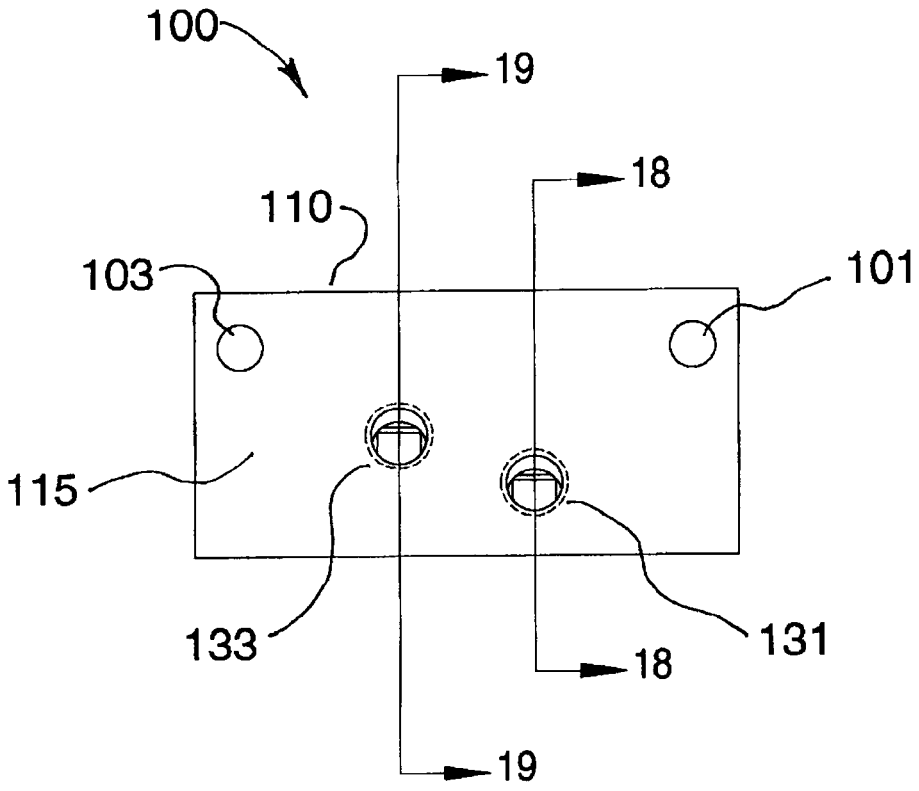
FIG. 17 is a right side view of the mounting block shown in FIG. 14.
Figure 18:
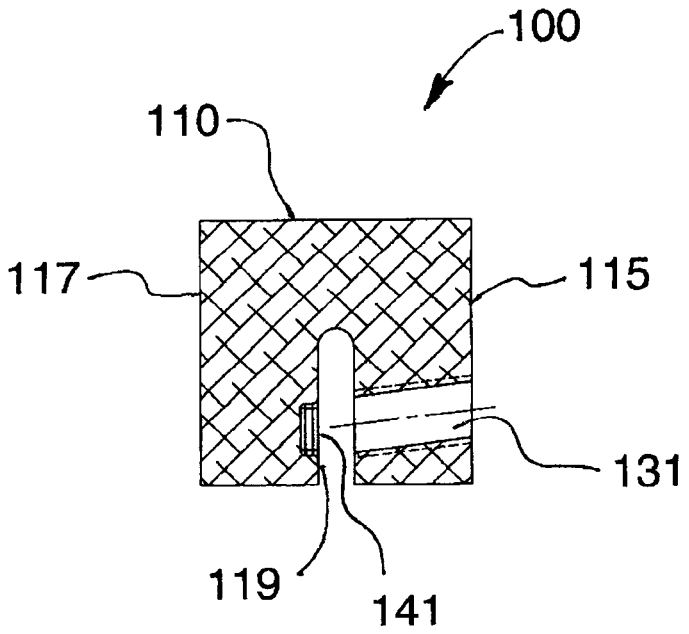
FIG. 18 is a section view taken along line 19-19 in FIG. 17.
Figure 19:
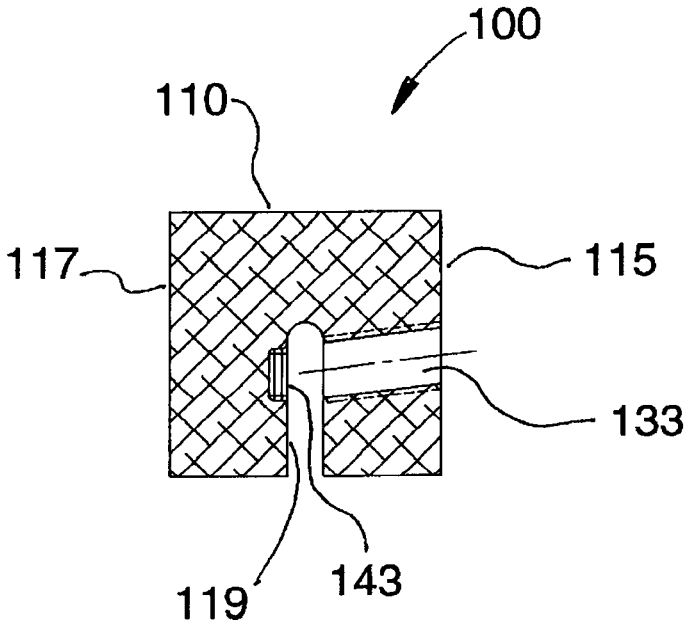
FIG. 19 is a section view taken along line 19-19 in FIG. 17.

The mount 100 shown in FIGS. 14-19 has two holes 101 and 103 for holding objects to be mounted on the roof. Mount 100 in this example is constructed as a block 110. An upward groove 119 for receiving a sheet metal seam divides block 110 into an upper top portion 113 and two lower side portions 115 and 117. Object holding holes 101 and 103 extend through the upper section. These object holding holes can be simple open holes for fasteners to pass through, or they can be tapped to accept a threaded fastener.

Threaded downward angles holes 131, 133 are formed through one side 135 of the body. Complementary rectangular or square recesses 141, 143 are formed in the opposite side's 145 inner face 147.

The holes 131, 133 receive elliptical-tipped set screws that are downward angled. The screws are tightened to engage and distort the seam and to press opposite sides of the seam into the linear, angular recesses 141, 143. The downward angled holes 131 and 133 and the complementary recesses 141 and 143 are at different levels to engage different parts of the seams. The hole 131 and complementary recess 141 are positioned below the hole 133 and recess 143. The elliptical tip of a set screw in hole 131 and recess 141 cooperate with the two-layer upstanding parallel metal roof plate portions below the seam to distort the parallel plate portions and to press them into the linear edged receiver 141 and to anchor the block against lifting or sliding. A set screw turned in hole 133 and recess 143 cooperate with the rolled five-layer part of the seam to distort the seam and press it partially into the linearly edged recess 143.

Embodiments of the invention have unitary bodies and blades made from high strength Almag 35 alloy with good elongation characteristics. Set screws are made from ⅜" 306 stainless steel and are tested to withstand 225 ft. lbs. of torque.

While the invention has been described with reference to specific embodiments, modifications and variations of the invention may be constructed without departing from the scope of the invention, which is defined in the following claims.

The invention claimed is:

1. Apparatus comprising a mount having a body adapted for mounting on a seam of a metal roof, the body having a top portion and first and second side portions respectively having first and second spaced inner surfaces adapted for positioning on opposite sides of a seam of a metal roof, at least one inward and downward angled threaded fastener-receiving hole extending through the first side portion and adapted for receiving a fastener extending at a downward angle to engage a roof seam.

2. The apparatus of claim 1, wherein the first and second sides respectively have first and second inner surfaces, and wherein the downward angle of the at least one fastener-receiving threaded hole is about 5° to 20° to a direction perpendicular to the first inner surface.

3. The apparatus of claim 1, wherein the first and second sides respectively have first and second inner surfaces, and wherein the downward angle of the at least one fastener-receiving threaded hole is about 10° to a direction perpendicular to the first inner surface.

4. The apparatus of claim 1, wherein the first and second sides respectively have first and second inner surfaces, and wherein the second inner surface has at least one recess opposite an opening of the at least one fastener-receiving threaded hole in the first inner surface.

5. The apparatus of claim 4, wherein a center of the at least one recess is centered below a center of the at least one fastener-receiving hole.

6. The apparatus of claim 4, wherein the at least one recess has walls perpendicular to the second inner surface.

7. The apparatus of claim 4, wherein the at least one recess has a polygon-shaped perimeter.

8. The apparatus of claim 4, wherein the at least one recess a rectangular shaped perimeter.

9. The apparatus of claim 4, wherein the at least one recess is square.

10. The apparatus of claim 1, wherein the top portion has a surface, wherein the first and second side portions have first and second bottom surfaces, and wherein the first and second bottom surfaces have opposite first and second downward extending lobes.

11. The apparatus of claim 10, wherein the first and second lobes hold one of the at least one fastener-receiving holes and one of the at least one recesses.

12. The apparatus of claim 11, wherein the body has first and second ends, and wherein the lobes are positioned nearer the first end of the body.

13. Apparatus comprising a mount having a body adapted for mounting on a seam of a metal roof, the body having a top portion and first and second side portions respectively having first and second spaced inner surfaces adapted for positioning on opposite sides of a seam of a metal roof, at least one inward and downward angled fastener-receiving hole extending through the first side portion and adapted for receiving a fastener extending at a downward angle to engage a lower area of a roof seam, wherein the first and second sides respectively have first and second inner surfaces, and wherein the second inner surface has at least one recess opposite an opening of the at least one fastener-receiving hole in the first inner surface, wherein the top portion has a surface, wherein the first and second side portions have first and second bottom surfaces, and wherein the first and second bottom surfaces have opposite first and second downward extending lobes, wherein the first and second lobes hold one of the at least one fastener-receiving holes and one of the at least one recess, wherein the body has first and second ends, and wherein the lobes are positioned nearer the first end of the body, wherein the at least one inward and downward angled fastener-receiving hole comprises first and second inward and downward angled fastener-receiving holes extending through the first side portion of the body, the first fastener-receiving hole being positioned in or near the first lobe and the second fastener-receiving hole is positioned in the first side nearer the second end and nearer the top portion, and wherein the at least one recess further comprises first and second recesses in the second inner surface opposite openings of the fastener-receiving holes in the first inner surface, wherein the second hole and the second recess are relatively raised with respect to a seam on a roof, and the first hole and the first recess are relatively lowered with respect to the seam on the roof.

14. The apparatus of claim 13, further comprising a snow and ice blade transverse to the body at the first end of the body, and wherein the snow and ice blade has lower edge portions nearly aligned with the first and second bottom surfaces.

15. Apparatus comprising a snow guard, further comprising a roof seam attachment body having a top portion adapted for overlying a seam of a metal roof, and having spaced first and second side portions extending downward from the top portion, the first side portion having first and second threaded set screw-receiving through holes and the second side portion having first and second polygon-shaped recesses with angular walls in an internal surface opposite openings of the screw-receiving holes.

16. The apparatus of claim 15, wherein the recesses have rectangular sides extending inward from the internal surface.

17. The apparatus of claim 16, further comprising set screws having elliptical inner ends mounted in the set screw-receiving holes.

18. The apparatus of claim 15, further comprising lobes extending downward from bottom surfaces of the side portions beneath the first set screw opening and the first recess, whereby the first set screw opening and the first recess are lower so that a first set screw and the first recess are adapted to engage a lower portion of a double standing seam and the second set screw opening and the second recess are higher so that a second set screw and the second recess are adapted to engage an upper portion of a double standing seam.

19. The apparatus of claim 18, further comprising a snow blade transversely connected to an end portion of the body near the lower first through hole.

20. A method of locking an object to a roof panel, comprising providing a roof mount having a top portion and spaced first and second side portions extending downward from the top portion and adapted for enclosing a portion of a standing seam on a roof, providing the first side portion with first and second through holes, providing threads in the through holes, providing first and second polygon-shaped recesses with perpendicular sides extending into an inner surface of the second side portion opposite inner openings of the through holes, adapted for engaging and deforming layers of the standing seam into said recesses.

21. The method of claim 20, further comprising providing fasteners in the threaded through holes and providing elliptical ends on the set screws for deforming the standing seam with the elliptical ends and pressing portions of the seams into the recesses.

22. The method of claim 21, further comprising providing downward extending lobes on bottom surfaces of the first and second side portions near first ends of the side portions and providing the first hole and the first recess in or near the lobes.

23. The method of claim 20, wherein the providing of the first and second recesses further comprises providing rectangular walls in the first and second recesses.

24. A method of locking an object to a roof panel, comprising providing a roof mount having a top portion and spaced first and second side portions extending downward from the top portion and adapted for enclosing a portion of a standing seam on a roof, providing the first side portion with first and second through holes, providing threads in the through holes, providing first and second polygon-shaped recesses with perpendicular sides extending into an inner surface of the second side portion opposite inner openings of the through holes, adapted for engaging and deforming layers of the standing seam into said recesses, further comprising said first and second threaded through holes oriented in a downward and inward manner, providing the first downward and inward extending through hole and the first recess in positions adapted for engaging a lower two layers of a double standing seam, respectively positioning the second through hole and second recess higher than the first hole and the first recess and adapted for engaging a higher five layers of the double standing seam between the second hole and the second recess.

25. The apparatus of claim 15, further comprising a snow retention blade transversely connected to the roof seam attachment body portion.

26. Apparatus comprising a roof mount for connecting to metal roof panels, the roof mount further comprising a top portion and spaced first and second side portions extending downward from the top portion and adapted for enclosing a portion of a standing seam on a roof, the first side portion having first and second through holes, threads in the through holes, first and second recesses having polygon-shaped perimeters with perpendicular sides extending into an inner surface of the second side portion opposite inner openings of the through holes, adapted for engaging layers of the standing seam between the first and second threaded through hole and the first and second recesses.

27. The apparatus of claim 26, further comprising a top portion and spaced first and second side portions extending downward from the top portion and adapted for enclosing a portion of a standing seam on a roof, the first side portion having first and second downward and inward extending through holes, threads in the through holes, first and second recesses of a polygon-shaped perimeter with perpendicular sides extending into an inner surface of the second side portion opposite inner openings of the through holes, the first downward and inward extending through hole and the first recess in positions adapted for engaging a lower two layers of a double standing seam, respectively positioning the second through hole and second recess higher than the first hole and the first recess and adapted for engaging a higher five layers of the double standing seam between the second hole and the second recess.

* * * * *